US007033049B2

(12) United States Patent
Lin

(10) Patent No.: US 7,033,049 B2
(45) Date of Patent: Apr. 25, 2006

(54) LAMP

(76) Inventor: Shih-Ming Lin, No. 8, Lane 191, Hsihsin St., Chuangya Village, Hsiushui Hsiang, Changhua Hsien (TW)

( * ) Notice: Subject to any disclaimer, the term of this patent is extended or adjusted under 35 U.S.C. 154(b) by 98 days.

(21) Appl. No.: 10/883,444

(22) Filed: Jul. 1, 2004

(65) Prior Publication Data

US 2006/0002118 A1 Jan. 5, 2006

(51) Int. Cl.
*F21S 8/08* (2006.01)

(52) U.S. Cl. ..... 362/412; 362/410

(58) Field of Classification Search ..... 362/412, 362/410

See application file for complete search history.

(56) References Cited

U.S. PATENT DOCUMENTS 1,863,607 A * 6/1932 Sabath ..... 362/412
3,025,392 A * 3/1962 Worth ..... 362/362
6,616,298 B1 * 9/2003 Bernhard ..... 362/650
6,916,108 B1 * 7/2005 Swanson ..... 362/410

* cited by examiner

*Primary Examiner*—Stephen Husar
*Assistant Examiner*—Hargobind S. Sawhney
(74) *Attorney, Agent, or Firm*—Dellett & Walters

(57) ABSTRACT

A lamp includes a base with a through hole, a shade casing, a bulb mounting seat assembly and multiple light bulbs. The shade casing is mounted on the base and has a top opening and a bottom through hole aligned with the through hole in the base. The bulb mounting seat assembly includes a bulb mounting seat covering the top opening, a sleeve mounted and held in the aligned through holes, an elongated connection tube and a tightening fastener. The elongated connection tube is attached to the bulb mounting seat and has a bottom threaded end extending out of the sleeve onto which the tightening fastener is screwed. The light bulbs are mounted on the bulb mounting seat inside the shade casing. Consequently, loosening the tightening fastener allows removal of the bulb mounting seat from the top opening to replace conveniently the failed light bulbs.

6 Claims, 4 Drawing Sheets

LAMP

BACKGROUND OF THE INVENTION

1. Field of the Invention

The present invention relates to a lamp, and more particularly to a lamp that has a demountable bulb mounting seat on which at least one light bulb is mounted, and the bulb mounting seat allows quick and easy replacement of the light bulb when it is damaged or eventually fails.

2. Description of Related Art

Lamps make vision possible in the night or a dark place. Generally, a conventional lamp in accordance with the prior art comprises a base, at least one light bulb and a shade casing. The shade casing can be shaped in various figures and has a great diversity of design for ornamentation. The shade casing is attached to the base and covers the light bulb inside. The shade casing is made of transparent or translucent materials so that the lamp presents soft light beams.

The light bulb of the conventional light is mounted on the inside bottom of the shade casing. Since the shade casing is deep, replacing the light bulb on the inside bottom of the shade casing is neither easy nor convenient when the light bulb eventually fails.

To overcome the shortcomings, the present invention provides a lamp having a demountable bulb mounting seat to mitigate or obviate the aforementioned problems.

SUMMARY OF THE INVENTION

The main objective of the invention is to provide a simple lamp having a demountable bulb mounting seat and a shade casing, and the bulb mounting seat is releasably mounted on the shade casing so that both assembling and replacing light bulbs on the bulb mounting seat inside the shade casing are easy and convenient.

A lamp in accordance with the present invention includes a base, a shade casing, a bulb mounting seat assembly and an illuminative device. The base has a through hole. The shade casing is mounted on the base and has a top opening and a bottom through hole aligned with the through hole in the base. The bulb mounting seat assembly includes a bulb mounting seat, a sleeve, two sleeve fasteners, an elongated connection tube and a tightening fastener. The bulb mounting seat is demountably mounted on the shade casing and covers the top opening in the shade casing. The sleeve is mounted in the aligned through holes in the shade casing and the base and has two threaded ends. The threaded ends extend respectively out of the bottom through hole and the through hole. The sleeve fasteners respectively screw onto the extended threaded ends of the sleeve to unite the shade casing and the base. The elongated connection tube is attached to the bulb mounting seat and has a bottom threaded end passing through the sleeve and extending out of the sleeve. The tightening fastener screws onto the extended bottom threaded end of the elongated connection tube to hold the bulb mounting seat in position. The illuminative device includes at least one light bulb mounted on the bulb mounting seat inside the shade casing. Consequently, loosening the tightening fastener allows removal of the elongated connection tube from the sleeve and the bulb mounting seat from the top opening in the shade casing so as to replace conveniently the light bulb when the light bulb fails.

Other objectives, advantages and novel features of the invention will become more apparent from the following detailed description when taken in conjunction with the accompanying drawings.

DETAILED DESCRIPTION OF PREFERRED EMBODIMENT

Figure 1:
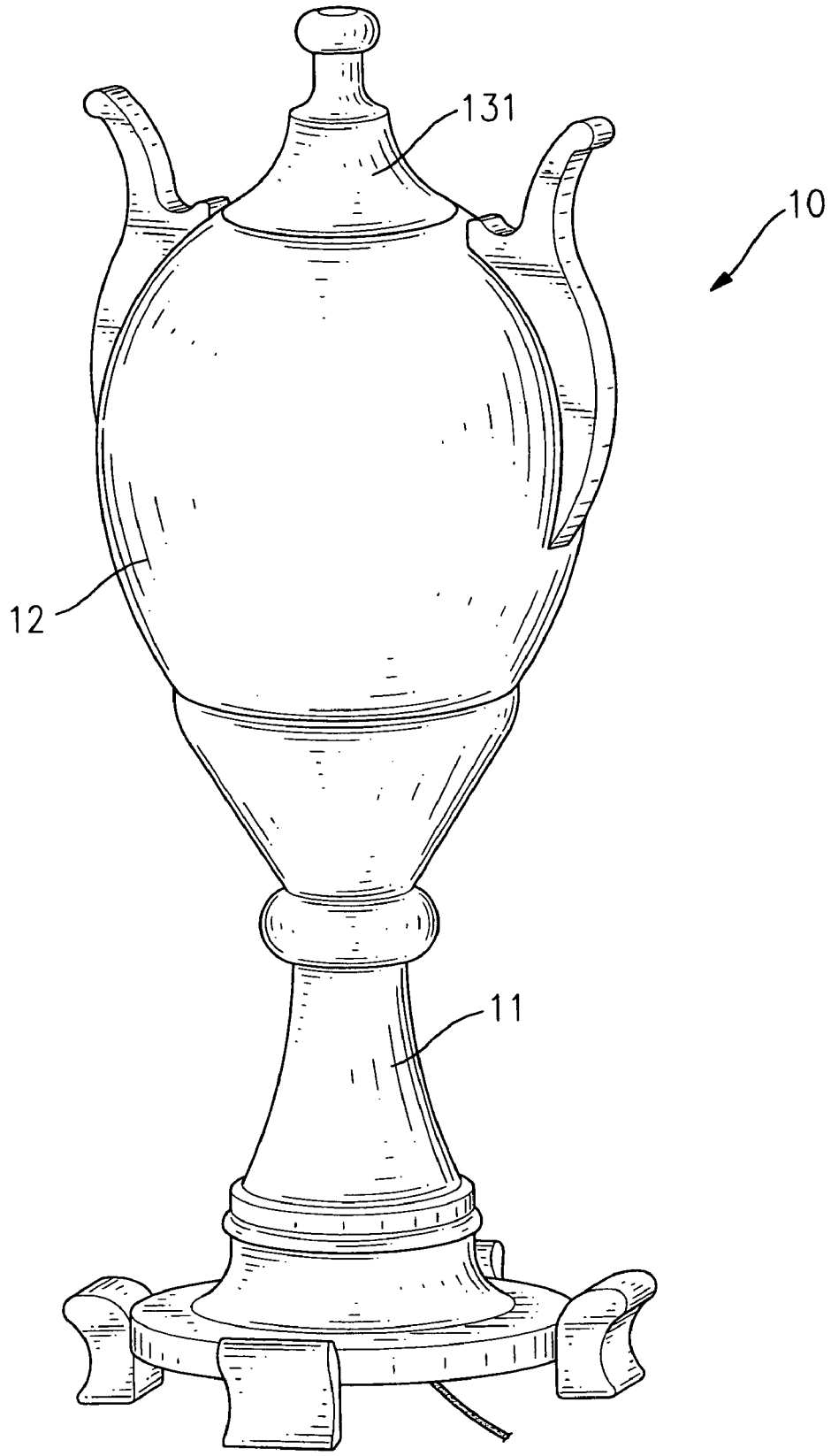
FIG. 1 is a perspective view of a lamp in accordance with the present invention.
Figure 2:
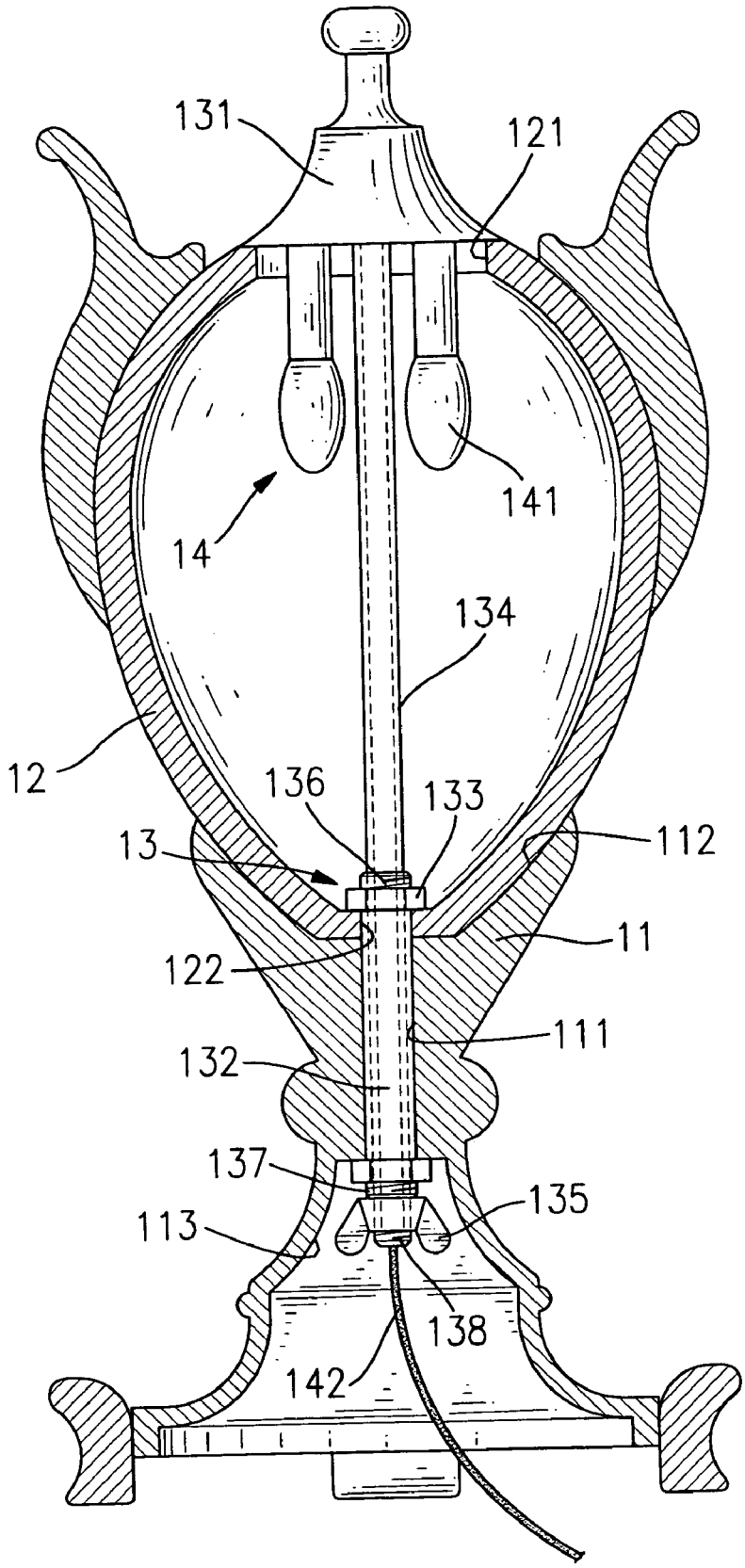
FIG. 2 is a side elevational view in partial section of the lamp in FIG. 1.

With reference to FIGS. 1 and 2, a lamp (10) in accordance with the present invention comprises a base (11), a shade casing (12), a bulb mounting seat assembly (13) and an illuminative device (14).

The base (11) has a top, a bottom and a through hole (111) defined through the top to the bottom. The top of the base (11) has a top recess (112). The bottom of the base (11) has a bottom recess (113). The through hole (111) communicates with both the top and the bottom recesses (112, 113).

The shade casing (12) is mounted on the top of the base (11), is partially held in the top recess (112) in the base (11) and has ajar shape. The jar-shaped shade casing (12) is made of transparent or translucent materials that permit the passage of light. The shade casing (12) has a top opening (121) and a bottom through hole (122). The bottom through hole (122) in the shade casing (12) is aligned with the through hole (111) in the base (11) when the shade casing (12) is held in the top recess (112) of the base (11).

The bulb mounting seat assembly (13) comprises a bulb mounting seat (131), a sleeve (132), two sleeve fasteners (133), an elongated connection tube (134) and a tightening fastener (135).

Figure 3:
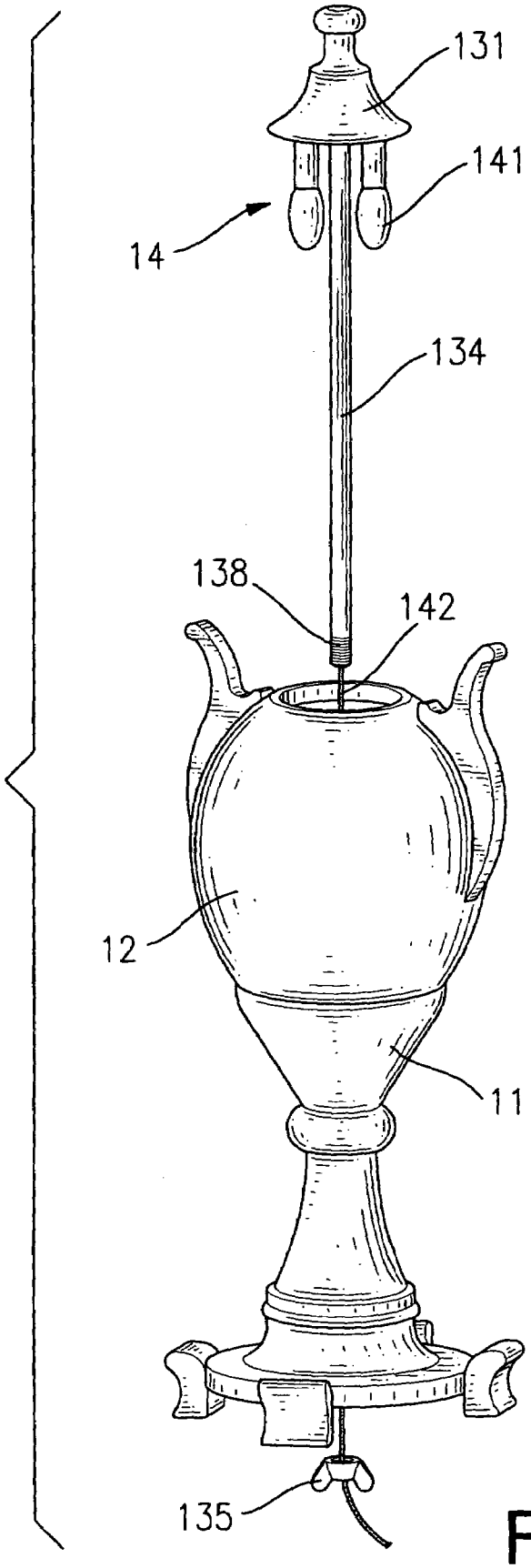
FIG. 3 is an exploded perspective view of the lamp in FIG. 1.
Figure 4:
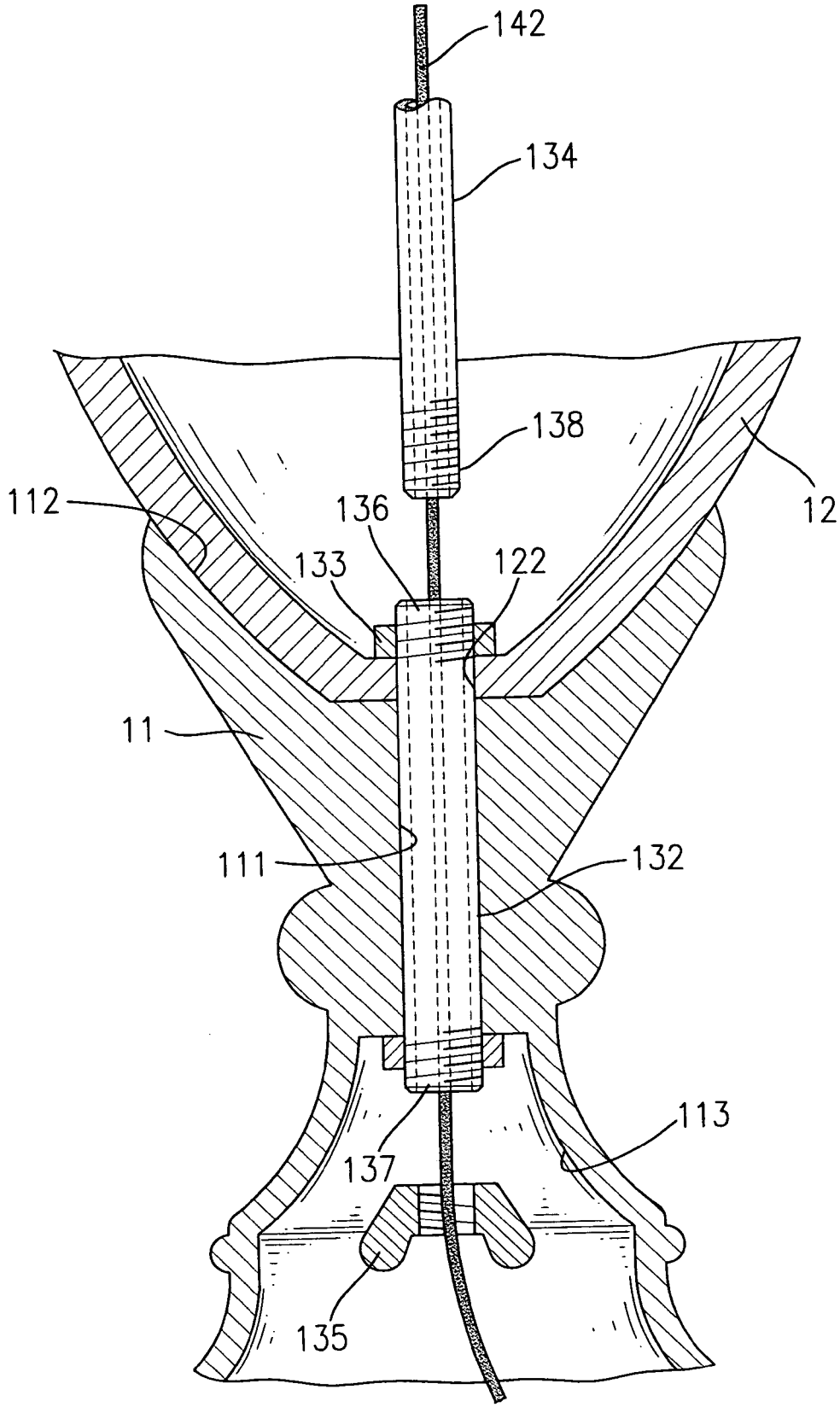
FIG. 4 is an enlarged sectional, elevational view of the lamp in FIG. 1.

With further reference to FIGS. 3 and 4, the bulb mounting seat (131) is a lid for the jar-shaped shade casing (12), is releasably mounted on the shade casing (11) and covers the top opening (121) in the shade casing (12). The sleeve (132) is mounted and held in the aligned bottom through hole (122) in the shade casing (12) and the through hole (111) in the base (11) and has an upper threaded end (136) and a lower threaded end (137). The upper and the lower threaded ends (136, 137) extend respectively out of the bottom through hole (122) in the shade casing (12) and the through hole (111) in the base (11) onto which the sleeve fasteners (133) screw respectively. Therefore, the sleeve fasteners (133) cooperating with the sleeve (132) unite the casing (12) and the base (11).

The elongated connection tube (134) is attached to the bulb mounting seat (131) and has a bottom threaded end (138) opposite to the bulb mounting seat (131). The bottom threaded end (138) of the elongated connection tube (134) extends through the sleeve (132) from the inside of the shade casing (12) and protrudes from the sleeve (132) at the bottom of the base (10).

The tightening fastener (135) may be a wing nut and screws onto the bottom threaded end (138) of the elongated connection tube (134). Therefore, the tightening fastener (135) will hold and fasten the bulb mounting seat (131) on the shade casing (12) through the elongated connection tube (134) when the tightening fastener (135) is tightened.

The illuminative device (14) is mounted on the bulb mounting seat assembly (13) and comprises at least one light bulb (141) and a power supply cord (142). An amount of the at least one light bulb (141) can be two and the two light bulbs (141) are mounted on the bulb mounting seat (131). The light bulbs (141) are held inside the shade casing (12) and produce light beams when the bulb mounting seat (131) is held in the top opening (121) of the shade casing (12).

The power supply cord (142) is coupled to each one of the light bulbs (141) and extends through and out of the elongated connection tube (134) and the tightening fastener (135) at the bottom of the base (11). The power supply cord (142) establishes a path of transmitting electricity to drive the coupled light bulbs (141) to produce light.

Therefore, loosening the tightening fastener (135) and removing the tightening fastener (135) from the bottom threaded end (138) of the elongated connection tube (134) allows the elongated connection tube (134) to be removable. The bulb mounting seat (131) is removable from the top opening (121) in the shade casing (12) so that replacing the light bulbs (141) is easy and convenient.

When the operations of replacing the light bulbs (141) are completed, the bulb mounting seat (131) is remounted into and held in the top opening (121) of the shade casing (12) by reinserting the bottom threaded end (138) of the elongated connection tube (134) into the sleeve (132). The bottom threaded end (138) of the elongated connection tube (137) extends out of the sleeve (132) onto which the tightening fastener (135) screws tightly again. Thus, the light bulbs (141) are positioned inside the shade casing (12) so as to present soft light beams.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the scope of the appended claims.

What is claimed is:

1. A lamp comprising a base having a top, a bottom and a through hole defined through the top to the bottom;

a shade casing mounted on the top of the base and having a top opening and a bottom through hole aligned with the through hole in the base;

a bulb mounting seat assembly comprising a bulb mounting seat demountably mounted on the shade casing and covering the top opening in the shade casing;

a sleeve mounted in the aligned bottom through hole in the shade casing and the through hole in the base and having an upper threaded end and a lower threaded end, and the upper and the lower threaded ends extended respectively out of the bottom through hole in the shade casing and the through hole in the base;

two sleeve fasteners respectively screwed onto the upper and the lower threaded ends to unite the shade casing with the base;

an elongated connection tube attached to the bulb mounting seat and having a bottom threaded end, and the bottom threaded end of the elongated connection tube extended into the sleeve and extended out of the sleeve at the bottom of the base; and a tightening fastener screwed onto the bottom threaded end of the elongated connection tube; and an illuminative device mounted on the bulb mounting seat assembly and comprising at least one light bulb mounted on the bulb mounting seat and held inside the shade casing; and a power supply cord coupled to each one of the at least one light bulb and extending through and out of the elongated connection tube at the bottom of the base.

2. The lamp as claimed in claim 1, wherein the sleeve fasteners mounted screwed onto the upper and the lower threaded ends of the sleeve are nuts.

3. The lamp as claimed in claim 1, wherein the shade casing is made of transparent materials.

4. The lamp as claimed in claim 1, wherein the shade casing is made of translucent materials.

5. The lamp as claimed in claim 1, wherein the tightening fastener is a wing nut.

6. The lamp as claimed in claim 1, wherein the top of the base has a top recess, and the shade casing is partially held in the top recess.

* * * * *